US007265282B2

(12) United States Patent
Membreno et al.

(10) Patent No.: US 7,265,282 B2
(45) Date of Patent: Sep. 4, 2007

(54) UNIVERSAL TUNER MOUNT WITH SPRING-LOADED LINK

(76) Inventors: Agustin J. Membreno, 2801 Prestonwood Dr., Plano, TX (US) 75093; Mark L. Wilson, 3331 Kiest Forest Dr., Dallas, TX (US) 75233

( * ) Notice: Subject to any disclaimer, the term of this patent is extended or adjusted under 35 U.S.C. 154(b) by 24 days.

(21) Appl. No.: 11/163,069

(22) Filed: Oct. 4, 2005

(65) Prior Publication Data

US 2006/0075875 A1 Apr. 13, 2006

Related U.S. Application Data

(63) Continuation-in-part of application No. 10/604,317, filed on Jul. 10, 2003, now abandoned.

(51) Int. Cl.
*G10G 3/00* (2006.01)

(52) U.S. Cl. ..... 84/45.3

(58) Field of Classification Search ..... 84/394, 84/454, 290, 453

See application file for complete search history.

(56) References Cited

U.S. PATENT DOCUMENTS 892,105 A 6/1908 White ..... 248/60
3,576,149 A 4/1971 Slingerland ..... 84/421
4,734,001 A 3/1988 Bennett ..... 411/119
5,637,820 A 6/1997 Wittman ..... 84/454
5,728,959 A 3/1998 O'Rorke ..... 84/453
5,854,437 A * 12/1998 Merrick et al. ..... 84/454
5,973,248 A 10/1999 Chen ..... 84/421
5,990,403 A 11/1999 Membreno et al. ..... 84/454
6,491,014 B1 12/2002 Eickert ..... 123/195 C
6,815,598 B1 11/2004 Liao ..... 84/327
7,074,998 B2 * 7/2006 Hurwicz ..... 84/454

OTHER PUBLICATIONS

US D402,864, 12/1998, Wilson et al. (withdrawn)

* cited by examiner

*Primary Examiner*—Kimberly Lockett
(74) *Attorney, Agent, or Firm*—Daniel V. Thompson

(57) ABSTRACT

A universal mount for acoustically coupling a musical instrument tuner to an instrument has a link connected to the tuner at one end, the link adapted and arranged to be repositionable, and a clamp connected to the other end of the link for acoustically attaching the tuner and link to the musical instrument.

7 Claims, 2 Drawing Sheets

UNIVERSAL TUNER MOUNT WITH SPRING-LOADED LINK

CROSS-REFERENCE TO RELATED APPLICATION

This is a continuation-in-part of U.S. patent application Ser. No. 10/604,317 filed Jul. 10, 2003 now abandoned.

BACKGROUND OF THE INVENTION

Electro-mechanical musical instrument tuners have been provided for acoustically coupling to musical instruments for sensing mechanical vibrations of the musical instruments to determine the pitch of tones being emitted by the musical instruments. The detected pitch is then used to provide an output indicating the pitch of the tone being played. These musical instrument tuners can be used both for tuning the musical instruments and for developing a player's ear for detecting the pitch being played, such as for teaching a person to recognize various intonations.

In the past, musical instrument tuners have been clamped directly to the instruments using C-type clamps to acoustically couple the tuners to the instruments, such that mechanical vibrations will pass to a vibratory motion detector mounted within the housing of the tuner. One type of C-type clamp is found in the lntellitouch™ PT1™ tuner offered by Onboard Research Corp. of Carrollton, Tex. This tuner has two opposed, parallel, planar pads that are urged into contact with the instrument and then locked with clamping pressure sufficient to hold the tuner on the instrument. While this tuner has been an outstanding success, a limitation of this device is that the simple, planar clamping pads are not well—adapted for attachment to round surfaces, such as brass horn pipes, violin necks, etc. In addition, this tuner is difficult to attach to brass or woodwind bells, due to the curved shapes and reinforced bell rims. Other C-type clamps typically have a threaded clamping member which is subject to over tightening of the threaded coupling, which may cause damage to the musical instruments from excessive forces being applied to the instrument. In addition, alligator clips have also been used to clip musical instrument tuners to instruments, which may result in teeth of the alligator clips placing scratch marks on the exterior of the instruments.

U.S. Pat. No. 5,990,403 issued to Membreno, et al., is directed to a tuner that has a special adapter for fixing the tuner to an instrument lyre commonly used with wind instruments. This attachment technique, while exceptionally effective for those type of instruments, is not useful with other instruments lacking such a lyre.

Past tuners have also been limited in the directions from they may be viewed when attached to the few attachment locations available. The PT1™ tuner mentioned above has a simple one-axis pivoting connection between the tuner and the clamp, which is usable in most applications, but greater freedom of relative positioning between the clamp and the tuner would yield a greater number of satisfactory uses.

Thus a need presently exists for a tuner mount that permits an increased number of attachment locations and enhanced positionability with respect to the user once attached.

SUMMARY OF THE INVENTION

A universal mount for acoustically coupling a musical instrument tuner to an instrument has a link connected to the tuner at one end, the link adapted and arranged to be repositionable, and a clamp connected to the other end of the link for acoustically attaching the tuner and link to the musical instrument.

BRIEF DESCRIPTION OF THE DRAWINGS

A more complete understanding of the invention and its advantages will be apparent from a review of the Detailed Description in conjunction with the following Drawings, in which.

DETAILED DESCRIPTION

Figure 1:
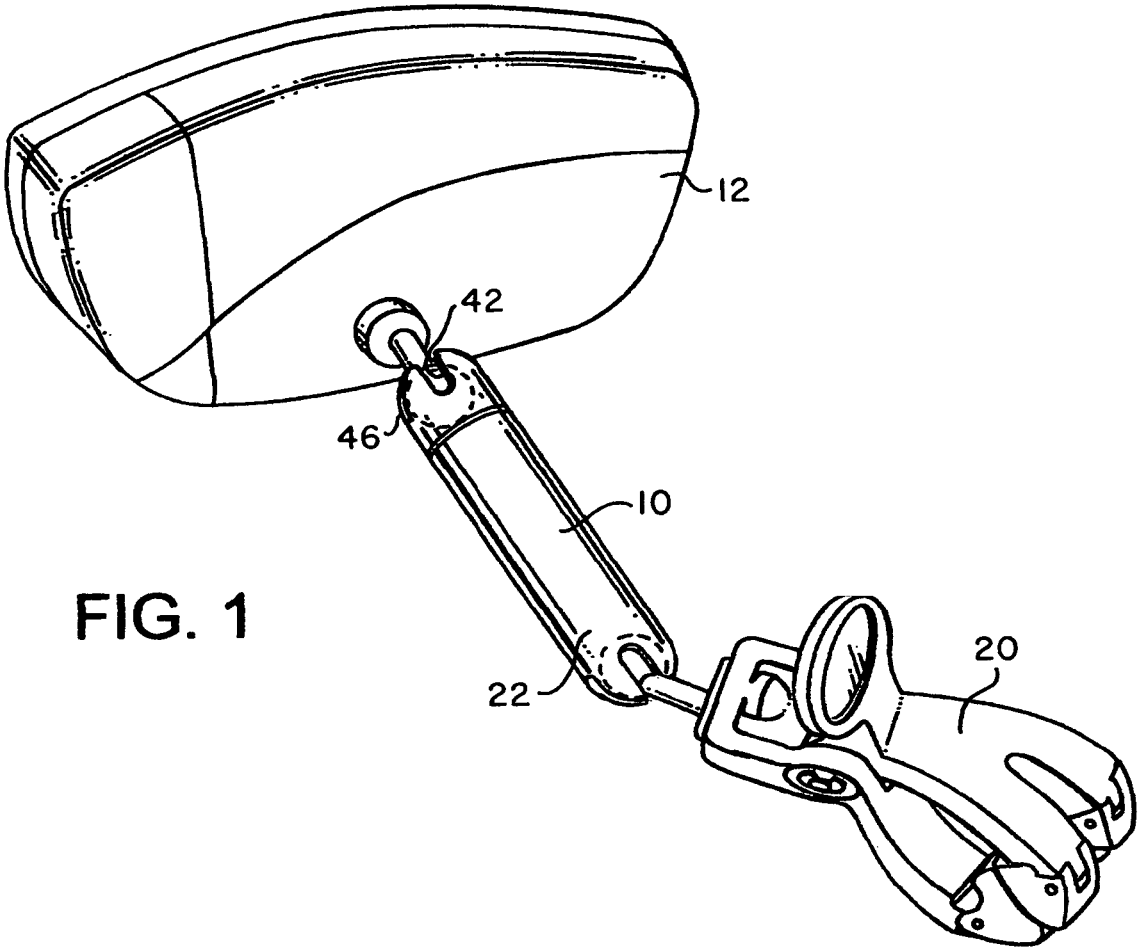
FIG. 1 is a perspective view of the apparatus of the present invention.

Referring initially to FIGS. 1-4, where like numerals indicate like and corresponding elements, a universal mount 10 is provided for acoustically coupling tuner 12 to a musical instrument 14.

Mount 10 includes a clamp 20, the clamp 20 being for acoustically coupling the tuner 12 to the musical instrument 14. A link 22 is adapted and arranged to be repositionable between the turner 12 and instrument 14.

Mount 10 includes a turner sphere 24 with a turner post 26 fixed to turner 12. A clamp sphere 28 with a clamp post 30 is fixed to clamp 20, the clamp 20 being for acoustically coupling the turner 12 and instrument 14.

Figure 4:
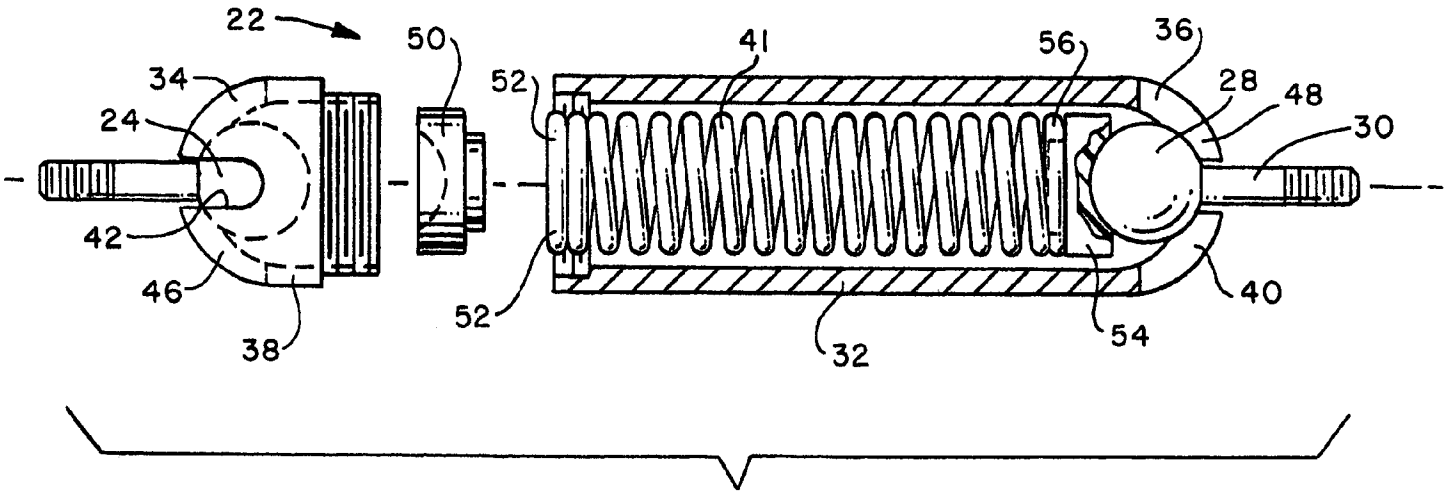
FIG. 4 is an exploded view of a link usable with the invention.

Link 22 has a central tubular section 32 between two retainment sections 34,36 at opposite ends 38,40 of the link 22. One of the two retainment sections is tuner end retainment section 34 and the other of the two retainment sections is clamp end retainment section 36. Tuner end retainment section 34 is separable from tubular section 32, as shown in FIG. 4, whereas clamp end retainment section 36 is integrally formed with tubular section 32. One skilled in the art will recognize that making the clamp end retainment section 36 separable, either instead of or in addition to the tuner end retainment section 34 being separable, would result in a functional equivalent.

A coil spring 41 is enclosed within the central tubular section 32. The tuner sphere 24 is retained within the link 22 by the tuner end retainment section 34, and the clamp sphere 28 is retained within the link 22 by the clamp end retainment section 36. The coil spring 41 is in a compressed state, such that the coil spring 41 biases the tuner sphere 24 and clamp sphere 28 into their respective retainment sections 34,36;

The coil spring 41 has a free length and spring rate sufficient to permit the tuner sphere 24 and clamp sphere 28 to be repositionable within their respective retainment sections 34,36 upon application of external force, yet fixed with respect to their respective retainment sections 34,36 absent application of external force.

A first slot 42 is located in the tuner end retainment section 24. The first slot 42 at the tuner end 38 permits lateral support of the tuner post 26 when the tuner post 26 is swivelled into engagement with the first slot 42 at the tuner end 38. A first slot 44 is provided in the clamp end retainment section 28. The first slot 44 at the clamp end 40 permits lateral support of the clamp post 30 when the clamp post 30 is swivelled into engagement with the first slot 44 at the clamp end 40.

A second slot 46 may additionally be located in the tuner end retainment section 24, the first and second slots 42,46 at the tuner end 38 permitting lateral support of the tuner post 26 when the tuner post 26 is swivelled into engagement with any of the first or second slots 42,46 at the tuner end 38. A second slot 48 may additionally be provided in the clamp end second retainment section 28, the first and second slots 44,48 at the clamp end 40 permitting lateral support of the clamp post 30 when the clamp post 30 is swivelled into engagement with any of the first or second slots 44,48 at the clamp end 40.

A tuner end cup member 50 is interposed between the tuner sphere 24 and an end 52 of the coil spring 41. A clamp end cup member 54 is interposed between the clamp sphere 28 and another end 56 of the coil spring 41. Cup members 50,54 are preferably formed of low-friction thermoplastic material.

In operation, the mount of the present invention is usable in coupling a tuner to essentially every instrument known, with the tuner display positionable for comfortable, ready viewing. The clamp is designed to attach securely to: (1) brass and woodwind instrument pipes from 0.040 to 1.35 inches in diameter; (2) brass and woodwind bells of any size; and (3) stringed instruments' scrolls, headstocks, pegboxes, bridges, tailpieces and bodies.

Figure 2:
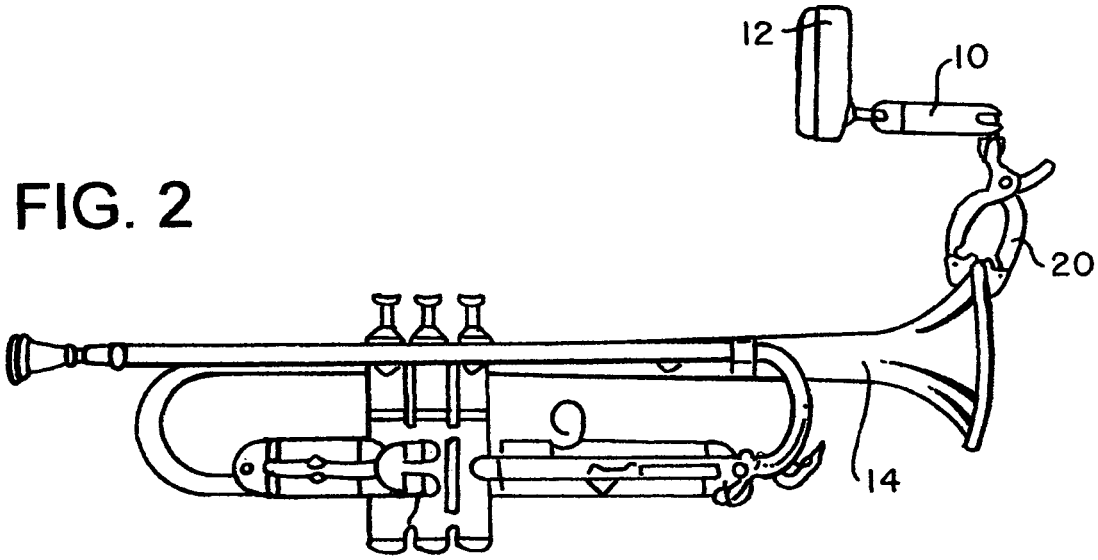
FIG. 2 is a side view of the invention in use on a musical instrument.
Figure 3:
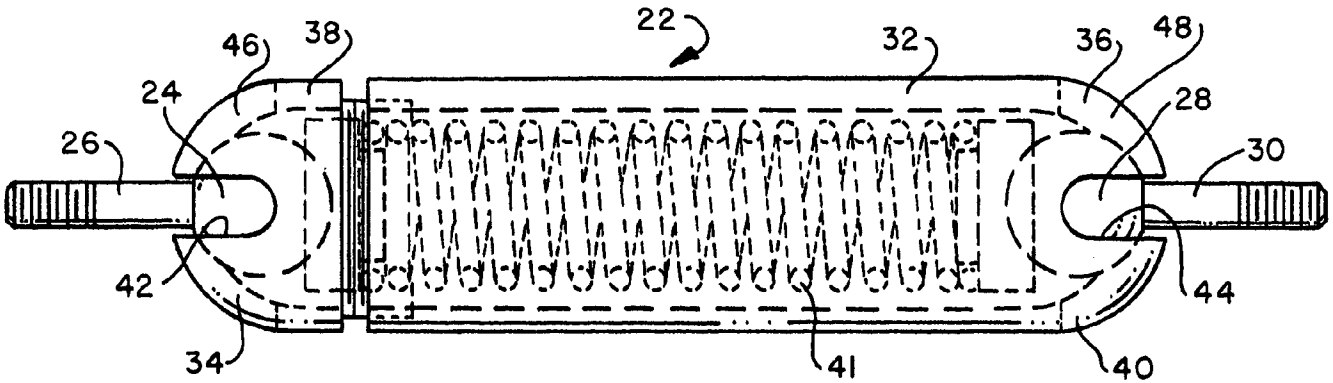
FIG. 3 is a side view of a link usable with the invention.

Once attached, the dual swiveling link ends permit the tuner to be quickly swung to the desired angle, then locked by engagement of the sphere posts with the slots. Greatest advantage is obtained by providing swiveling connections at both ends of the link, as shown, however a more economical construction might result from eliminating one of the swiveling connections with an accompanying decrease in usability. The slots in the curved surfaces of the ends permit exceptional stability of the connection, as well as resistance to creeping changes in the swivel connections, however, the mount is readily used without engaging slots at both ends, as shown in FIG. 2, where the tuner end does not have an engaged slot but the clamp end does.

The illustrated embodiment of the invention includes both the link and the clamp described. One skilled in the art will recognize that the link can be used with a different type of clamp to a lesser advantage.

While the invention has been illustrated and described as embodied in a tuner mount, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A universal mount for acoustically coupling a musical instrument tuner to an instrument, comprising:

a tuner sphere with a tuner post fixed to the tuner;

a clamp sphere with a clamp post fixed to a clamp, the clamp being for acoustically coupling the tuner to the musical instrument;

a link having a central tubular section between two retainment sections at opposite ends of the link, one of the two retainment sections being a tuner end retainment section and the other of the two retainment sections being a clamp end retainment section;

a coil spring enclosed within the central tubular section;

the tuner sphere being retained within the link by the tuner end retainment section and the clamp sphere being retained within the link by the clamp end retainment section;

the coil spring being in a compressed state, such that the coil spring biases the tuner sphere and clamp sphere into their respective retainment sections; and the coil spring having a free length and spring rate sufficient to permit the tuner sphere and clamp sphere to be repositionable within their respective retainment sections upon application of external force, yet fixed with respect to their respective retainment sections absent application of external force.

2. The apparatus of claim 1 with a first slot in the tuner end retainment section, the first slot at the tuner end permitting lateral support of the tuner post when the tuner post is swiveled into engagement with the first slot at the tuner end, and with a first slot in the clamp end retainment section, the first slot at the clamp end permitting lateral support of the clamp post when the clamp post is swivelled into engagement with the first slot at the clamp end.

3. The apparatus of claim 2 with a second slot in the tuner end retainment section, the first and second slots at the tuner end permitting lateral support of the tuner post when the tuner post is swiveled into engagement with any of the first or second slots at the tuner end, and with a second slot in the clamp end second retainment section, the first and second slots at the clamp end permitting lateral support of the clamp post when the clamp post is swivelled into engagement with any of the first or second slots at the clamp end.

4. The apparatus of claim 1 with a tuner end cup member interposed between the tuner sphere and an end of the coil spring and with a clamp end cup member interposed between the clamp sphere and another end of the coil spring.

5. The apparatus of claim 2 with a tuner end cup member interposed between the tuner sphere and an end of the coil spring and with a clamp end cup member interposed between the clamp sphere and another end of the coil spring.

6. The apparatus of claim 3 with a tuner end cup member interposed between the tuner sphere and an end of the coil spring and with a clamp end cup member interposed between the clamp sphere and another end of the coil spring.

7. A universal mount for acoustically coupling a musical instrument tuner to an instrument, comprising:

a tuner sphere with a tuner post fixed to the tuner;

a clamp sphere with a clamp post fixed to a clamp, the clamp being for acoustically coupling the tuner to the musical instrument;

a link having a central tubular section between two retainment sections at opposite ends of the link, one of the two retainment sections being a tuner end retainment section and the other of the two retainment sections being a clamp end retainment section;

a coil spring enclosed within the central tubular section;

the tuner sphere being retained within the link by the tuner end retainment section and the clamp sphere being retained within the link by the clamp end retainment section;

the coil spring being in a compressed state, such that the coil spring biases the tuner sphere and clamp sphere into their respective retainment sections;

the coil spring having a free length and spring rate sufficient to permit the tuner sphere and clamp sphere to be repositionable within their respective retainment sections upon application of external force, yet fixed with respect to their respective retainment sections absent application of external force;

with a first slot in the tuner end retainment section, the first slot at the tuner end permitting lateral support of the tuner post when the tuner post is swiveled into engagement with the first slot at the tuner end, and with a first slot in the clamp end retainment section, the first slot at the clamp end permitting lateral support of the clamp post when the clamp post is swivelled into engagement with the first slot at the clamp end;

with a second slot in the tuner end retainment section, the first and second slots at the tuner end permitting lateral support of the tuner post when the tuner post is swiveled into engagement with any of the first or second slots at the tuner end, and with a second slot in the clamp end second retainment section, the first and second slots at the clamp end permitting lateral support of the clamp post when the clamp post is swivelled into engagement with any of the first or second slots at the clamp end; and with a tuner end cup member interposed between the tuner sphere and an end of the coil spring and with a clamp end cup member interposed between the clamp sphere and another end of the coil spring.

* * * * *